United States Patent [19]

Beard et al.

[11] Patent Number: 4,813,494

[45] Date of Patent: Mar. 21, 1989

[54] STAKE DRIVER

[76] Inventors: Larry D. Beard, 19 Donner Creek Ct., Clayton, Calif. 94517; Larry L. Brigman, P.O. Box 533, Shasta, Calif. 96087; John C. Roderick, 1025 Azalea Way, Stockton, Calif. 95807

[21] Appl. No.: 19,005

[22] Filed: Feb. 26, 1987

[51] Int. Cl.[4] ..... B25D 1/04

[52] U.S. Cl. ..... 173/91; 173/126

[58] Field of Search ..... 173/90, 91, 120, 128–133, 173/126; 29/254, 255; 175/19–22; 125/40; 144/193 C; 30/277; 227/147

[56] References Cited

U.S. PATENT DOCUMENTS

| | | | |
|---|---|---|---|
| 2,525,316 | 10/1950 | Schiff | 173/91 |
| 2,754,585 | 7/1956 | Green | 30/277 |
| 3,036,482 | 5/1962 | Kenworthy et al. | 173/90 |
| 3,519,087 | 7/1970 | Santi | 173/91 |
| 3,565,351 | 2/1971 | Ross, Jr. | 173/90 |
| 3,568,657 | 3/1971 | Gue | 125/40 |
| 3,735,819 | 5/1973 | Ramsey | 173/126 |
| 4,101,088 | 7/1978 | Stauth | 173/91 |
| 4,241,795 | 12/1980 | Landry | 173/90 |
| 4,261,424 | 4/1981 | Gonterman et al. | 173/91 |
| 4,557,409 | 12/1985 | Hecock et al. | 227/147 |

*Primary Examiner*—Frank T. Yost
*Assistant Examiner*—James L. Wolfe
*Attorney, Agent, or Firm*—Robert T. Kloeppel

[57] ABSTRACT

A stake driver having a first rod that has at least one solid end for driving a stake. The other end may be pointed. A second larger diameter rod is slidably insertable over the first rod. One of the open ends of the second rod is located over a stake. Then the first rod is moved upward to allow the stake to be encircled by the open end of the second rod. The end of the second rod may be slotted to accomodate a rectangular stake or marker fastened to the top of the stake. With one hand grasping the second rod, the other hand lifts the first rod and then releases it so that the first rod can free fall and drive the stake into the soil. If additional force is required to drive the pointed end of the first rod into the soil, a third rod is slid onto the second rod and screwably connected to it. The invention includes a removable shovel made from a fourth rod with a shovel blade secured to one end of the fourth rod which also can function as a surveying reflector support, with or without the shovel blade by means of a threaded member connected to the end of the fourth rod.

20 Claims, 1 Drawing Sheet

STAKE DRIVER

BACKGROUND OF THE INVENTION

1. Field of the Invention

This invention relates to an improved stake driver that drives a stake or hub into the soil in order to more quickly carry out staking for surveying, earthwork and other types of construction work were staking is required. More specifically the invention relates to a stake or hub driver that has a driving mechanism that is manually operatable without requiring the operator to bend down. Our invention also has features that allow it to serve as a pick, shovel, grade rod, and reflector support.

2. Discussion of Prior Art

In the construction industry, staking is required for: (1) a topographic survey of the site to be used in the preparation of plans for a structure; (2) locating in the soil a system of stakes or other markers such as hubs, pegs or ginies, both in plan and in elevation from which the construction crew can take measurements of earthwork and other measurements for the proper construction of structures; (3) the giving of line and grade as needed to replace stakes disturbed by construction; and (4) taking measurements necessary to determine the volume of work actually performed up to a given date as a evidence of percentage of completion of work so as to support a contractor's payment. Additionally, temporary stakes or other markers are usually set at the corners of proposed structures, as an approximate guide for beginning the excavation.

When a stake is to be driven into the soil, a crew member or grade setter is required to kneel down, hold the stake, peg or hub and drive it with a sledge hammer. Then the grade setter gets up and moves to the next location until all the necessary stakes or hubs are driven. If resistance in the soil is met, the grade setter is required to pick away or shovel the surface with the appropriate instrument. This job gets more difficult if the soil the grade setter is required to kneel on is rocky or wet. And in those cases where the stake or hub is used to give the top elevation, the grade setter starts the hub or stake and holds a ruler or sweed on the stake or hub. A grade setter reads the ruler from which he knows the approximate distance the stake or hub must be driven. The grade setter puts the ruler down, kneels on the soil and then after picking up his sledge hammer drives the stake or hub nearly the desired amount. He then sets his hammer down, picks up the ruler and the grade setter takes a second ruler reading. This process is continued until the ruler reading is equal to the difference between the height of the ruler and the desired elevation. A feather or other marking on the top of the stake or hub maybe fixed to the top of the stake or hub to mark its location. If the grade elevation is only a short distance below the existing grade elevation, often a hole is dug in order that the stake or hub may be driven to desired grade. If this is the case, a shovel must be close at hand.

So you can see, the procedure requires the grade setter who drives the stake or hub to carry with him a sledge hammer, shovel, pick and rod. It requires the grade setter to constantly stand up and then kneel. Further, the probability the operator of equipment commonly found at construction sites (such as scrapers, trucks, bulldozers, graders and rollers) of seeing the grade setter while in a kneeling position decreases dramatically.

Another activity that is common to the construction business is the use of sweeds to determine the final grade of a sidewalk or roadway. As one skilled in this art will recall, a sweed is a set of three metal rods with a flat disc that is located on the existing grade. The middle sweed has an adjustable rod with horizontal extensions spaced a tenth of a foot apart. The two other sweeds are located opposite ends of a line of sight which is parallel to the line on which the grade location lies. After the middle sweed is located over the location where the grade elevation is sought, a crew member looks across one of the outside sweeds along the horizontal extension of the middle sweed to the outside sweed. If the elevation is too high, the line of sight of the crew member will reveal that the extension of the middle sweed is too high above the desired grade. The middle sweed is then moved out of the way and the blade man or bulldozer operator removes some of the soil. This procedure is repeated until the required grade is reached.

These disadvantages in the prior art are reduced and some cases eliminated with the use of our invention.

SUMMARY OF THE INVENTION

Our invention has a first rod that has at least one solid end for driving a hub, peg, stake, or giny, all of which will be referred to hereinafter as a "stake". The other end of the first rod may be pointed so as to be usable as a pick to break through hard soil not immediately penetratable by the stake without damaging it. A second larger diameter rod slidably insertable over the first rod is located over the first rod. One of the open ends of the second rod is located over a stake. While in this position, the first rod is moved upward to allow the stake to be encircled by the open end of the second rod. This end may be slotted to accommodate a rectangular stake so that the rectangular stake is centrally located in the open end. The open end of course can be fabricated to accommodate any shape of stake. And of course the material of the stake is of no consequence, for our invention can drive a metal stake or wood stake or any other material that becomes available in the market place from which stakes are fabricated. Another function of the slot is to permit locating a feather. The feather is a marker with a means to fasten it to the top of the stake. It assists in locating a stake after it is driven in the soil. The feather is driven into the top of the stake at the same time the stake is driven into the soil.

With our invention held in position with one hand by grasping the second rod, the other hand lifts the first rod to a convenient height and then releases it so that the first rod can free fall and drive the stake into the soil. This procedure is repeated until the stake reaches the desired elevation.

If additional force is required to drive the pick into the soil, then a third rod is slid onto the second rod and screwably connected to it to keep the third rod in place.

Our invention includes a removable shovel component made from a fourth rod with a shovel blade secured to the one end of the fourth rod which also can function as a surveying reflector support, with or without the shovel blade and can be used to add weight to the first rod if its needed to drive a stake.

DESCRIPTION OF THE PREFERRED EMBODIMENT

Figures 1, 2, 3, 4, 5:
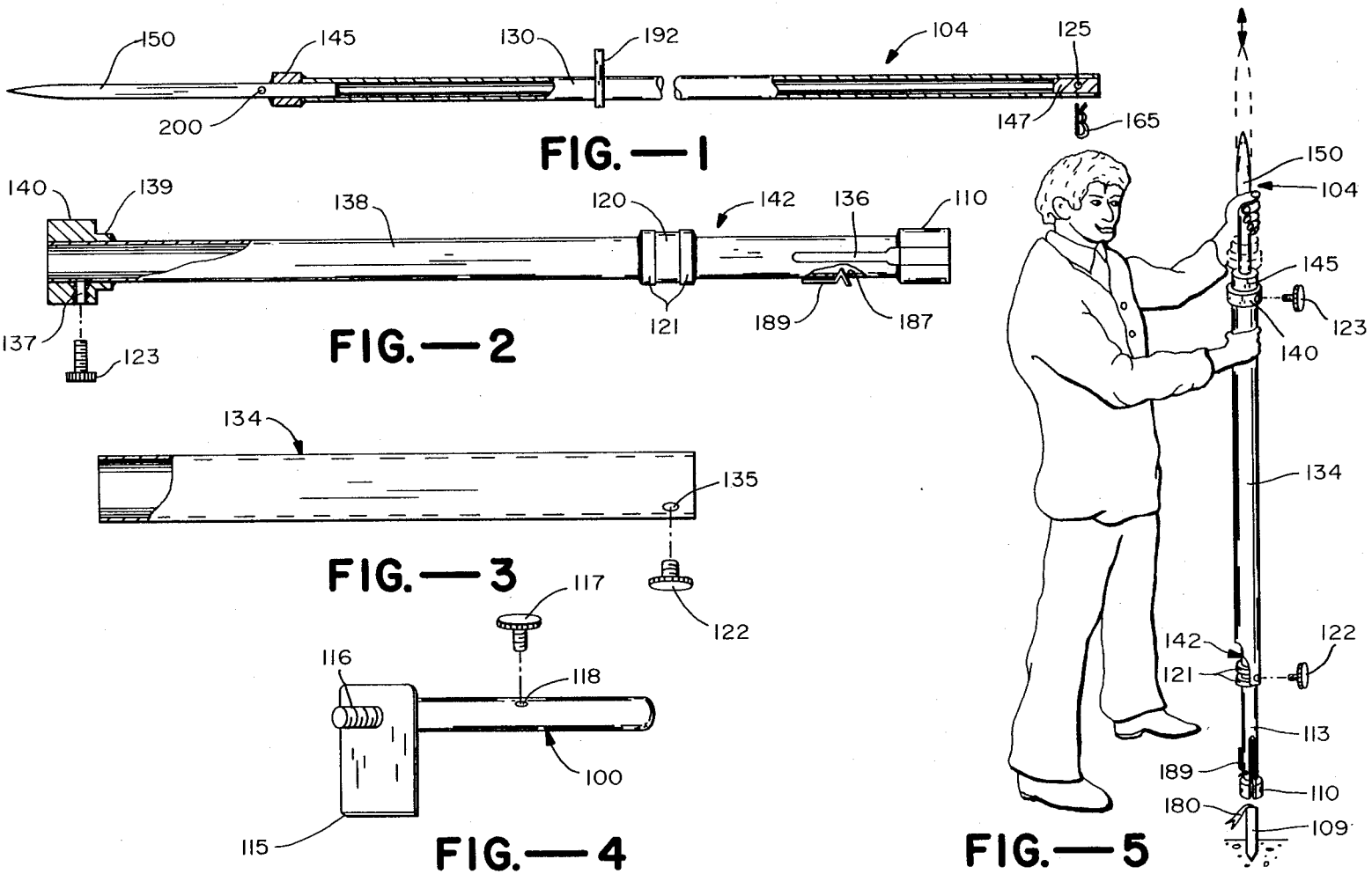
FIG. 1 illustrates the first rod.
FIG. 2 illustrates the second rod.
FIG. 3 illustrates the additional weight that may be added to the second rod.
FIG. 4 illustrates the shovel assembly.
FIG. 5 illustrates the invention in its entirety.

Our invention is illustrated in FIGS. 1 through 5. FIG. 1 illustrates a first rod 104. The rod is made from a standard pipe 130 that is welded or otherwise connected to solid shaft 150. The solid shaft 150 may be pointed at one end. This pointed end can be used to penetrate hard surfaces that cannot be penetrated by driving a stake without splitting a wood stake or buckling a metal one. Throughout the Description of the Preferred Embodiment and the claims, "stake" means a stake, peg, hub, or giny of any shape or material.

In FIG. 1 the opposite end of the pointed shaft extends through collar 145 and into the center of pipe 130. The shaft 150 and collar 145 are welded or screwed to one end of the pipe 130 so as to make it more easily removable for replacement. The other end of the rod 104 has a solid plug or end 147. The solid end is connected to rod 104 by welding or is screwed into pipe 130. In the solid end is bore 125 through which removable snap pin 165 or a bolt passes. The function of the bore and snap pin is described below. Though this first rod is illustrated as a combination of shafts connected together, it can be one continuous solid rod or hollow one with at least one end with a solid end for driving the stake.

The first rod 104 is coaxial and slidably located into the second rod 142, FIG. 2. This rod is fabricated from pipe or tubing 138 so that a bore extends longitudinally through the second rod. At one end of the pipe is collar 140, which is welded or otherwise fixed to the pipe. Collar 140, like collar 145 of the first rod 104, can be fabricated from bored rods; however, collar 140 has a boss 139. The boss is not necessary if sufficient strength can be developed by welding or otherwise. A threaded bore 137 is fabricated perpendicular to and through the side wall of collar 140 and pipe 138. The threaded bore accommodates a set screw 123, FIG. 5. The set screw is screwed into and through collar 140 so that the set screw presses against rod 130 of the first rod 104. The exact location of the set screw 123 against the first rod 104 determines the exact elevation of rod 142 above the stake. The set screw located in this manner prevents relative motion between the two rods because of the friction between the set screw and the first rod. The two rods 104 and 142 when so engaged act as one - a feature that makes it easier to carry our invention as well as use it as a grade rod to determine the elevation of a stake or to use the pointed end 150 as a pick. This describes the means for removably securing the first rod to the second rod so that the first and second rod act as one.

The other end of the pipe 138 is open with a slot 136. This is referred to as either the slotted open end or slotted end. The function of the slot is to permit the insertion of a "feather" 180, FIG. 5, or marker that is driven into stake 109 that is in turn driven into the soil. The slot holds the feather in place until driven by the first rod into the top of the stake. This feature allows the user of the invention to stand erect to insert the feather, and while remaining erect, lower the slotted end to the soil without the feather dropping out of the slot. The feather aids in locating the stake by the blademan or operator of the bulldozer. The slot also permits locating a rectangular stake into it. The slot receives one end of the rectangular stake and maintains it centrally in the second rod 142. At the extreme end of the slot is a short slotted reinforcing sleeve 110 connected to the pipe. This sleeve may be excluded if a person skilled in the art renders that the reinforcement of the slot is not necessary to maintain the original shape of the slotted end of the second rod.

As illustrated in FIG. 5, the first rod 104 is located coaxially into the second rod 142; then a stake is inserted into the slotted open end of the second rod 142. As mentioned, the stake may be round, square, rectangular as well as any other geometrical cross sectional shape. All that is required is the end configuration of rod 142 be appropriate for the geometric shape that is selected. The illustrated slotted end can accommodate most shapes of proportionate cross sectional areas. If it is necessary to have a stake much smaller than the opening at the slotted end 110 to fit snuggly into the slotted end, a means such as a detent spring that presses against the stake to hold the stake in place may be used. The following describes in more detail the means for keeping a stake that is smaller than the internal diameter of the second rod located therein. The detent spring 189 is connected to the second rod 142, so that the detent passes through hole 187 in rod 142 to rest against the stake to hold it in place. This feature permits the user to both insert the stake into the slotted end and lower the stake to the ground while the user remains erect. Other means of course can be used to keep the stake within rod 142.

After the stake 109, FIG. 5, is inserted into the slotted end of the second rod 142, the user holds the second rod in one hand and raises the first rod 104 with the other hand. The user then releases the first rod so that the first rod frees falls against the stake. The impact of the first rod against the stake drives the stake into the soil each time the first shaft impacts against the stake. If additional weight is determined by the user to be required to drive the stake into the soil, then a fourth or fourth rod described later can be located over the pointed end 150 to increase the weight of rod 104.

When the pointed end 150 of rod 104 is used to penetrate hard or rocky soil prior to driving the stake, the user inserts the first rod 104 into the second rod 142 as before and moves rod 142 against the collar 145 of first rod to drive the pointed end 150 into the hard soil. Another manner this driving force can be obtained is to decrease the size or remove collar 145 so that the second rod 142 slides over it. Then after inserting spring clip 165 into bore 200 near the pointed end of the first rod, the user moves the second rod against the spring clip to drive the pointed end 150. This describes two different means for stopping the motion of the second rod so that the resulting impact against the means drives the pointed end into the soil.

If it is determined that additional weight is needed by the user to effectively use or more easily drive the pointed end to break through hard or rocky soil, then weight 134 is located over the second rod 142. The weight 134 is a third rod fabricated from a pipe of sufficient diameter to slide over the second rod 142. At one end of the weight is threaded hole 135. A means for removably connecting the third rod to the second rod comprises a set screw 122 threaded into hole 135 so that the threaded end extends through the hole and between the shoulders 121 and against the collar 120 located on the second rod or if no collar 120 is used against the pipe 138 or in a bore therein (not illustrated). The other end of the weight rests against the collar 140 of the second rod. This is the preferred arrangement of the weight and rods 104 and 142 when our invention is carried into the field when it appears there will be a need to have an extra weight to drive a stake.

After the pointed end is driven into the ground, for example to be used to support an electronic surveyor reflector, our invention may be more easily removed by placing a spring clip 165 or bolt through bore 125 located near the solid end of the first rod. Then the action of moving the second rod 142 repeatingly against the spring clip 165 will drive the pointed end 150 of rod 104 out of the ground. This describes a means for stopping the motion of the second rod so that when the pointed end is driven into the soil the impact of the second rod against this means will drive the pointed end out of the soil.

Other attachments to our invention include a shovel assembly 100, FIG. 4. This assembly comprises a fourth or fourth rod fabricated from a pipe with a shovel blade 115 welded to or screwed on or otherwise connected to one end of the pipe. A threaded member 116 such as a pipe nipple or threaded stud may extend from the fourth rod. The threaded end 116 of the shovel permits screwing a reflector (not illustrated) commonly used with electronic survey equipment on it. This assembly can slide over either end of the first rod 104. The fourth rod may have a threaded bore 118 fabricated in it to accommodate a set screw 117. The fourth rod can be secured in place by screwing set screw 117 through bore 118 so that the set screw presses against rod 104 so as to function as a means for removably connecting the fourth rod to the first rod. If, however, the fitness of the fourth rod is close enough that it does not move significantly, then the set screw may be eliminated when the use of the fourth rod is slid over the first rod. The fourth rod may also be manufactured without the shovel rendering the fourth rod with the threaded member to function only as a reflector connection. When the fourth rod is inserted on the first rod, it adds additional weight to drive a stake as mentioned above.

Additionally, our invention eliminates the need of carrying to the field the middle sweed mentioned in the Background of the Invention. As noted there the middle sweed has horizontal extensions that are used to sight along or over to determine the difference between the actual elevation and the desired one. Since the lower most point of the first rod rests on the stake, by clamping a removable clamp 192 onto the portion of first rod 104 that is exposed above the second rod 142, the clamp performs like the horizontal extensions of the middle sweed to give the actual grade of the top of the stake. This describes a removable means for establishing the grade elevation of a stake.

From the above, the user of the invention eliminates carrying a sledge hammer, a shovel, a reflector support and middle sweed as well as eliminating constant bending down on one knee which at times is uncomfortable when the soil is wet or rocky.

Our experience indicates that stakes can be driven easier, quicker and safer. It is easier and quicker because fewer tools need be carried with the crew that position stakes. The use of the invention makes grade setting quicker because elevations of the stake can be done coincidentally with driving a stake. This eliminates the need for the user to drop his hammer, pick up a grade rod, stand up and take an elevation on the stake. Our invention eliminates this, for grades can be shot with our invention between releases of the first rod that drives the stake. The use of our invention is safer when cut and fill operations are conducted since the user standing in an upright position is more visible to the operators of various machinery located at a construction site in contrast to one who is on his knee driving a stake into the soil.

The foregoing description and drawings of the preferred embodiment will suggest other embodiments and variations within the scope of the claims to those skilled in the art, all of which are intended to be included in the spirt of the invention as herein set forth.

What we claim is:

1. A stake driver for use in driving stakes, hubs, pegs or ginies for surveys, earthwork measurements, and approximate guides for excavation by a user of the stake driver who stands in an upright position while using the stake driver comprising a first rod having at least one solid end and a second rod having a bore extending longitudinally through the second rod and two opposite open ends wherein one end is slotted, the first rod slidably locatable into the second rod and positionable over a stake inserted into the slotted open end of the second rod adjacent to soil so that the user grasps the second rod while lifting the first rod so in turn, when said first rod is released, the stake held in place against the soil by the second rod is driven into the soil by the impact of the first rod when the first rod hits the stake.

2. The stake driver of claim 1 wherein the first rod has a pointed end for penetrating the soil prior to driving the stake.

3. The stake driver of claim 2 including first means for stopping the motion of the second rod so that the resulting impact drives the pointed end into the soil, said first means located near the pointed end of the first rod, and a second means for stopping the motion of the second rod so that when the pointed end is driven into the soil the impact of the second rod against said means will drive the pointed end out of the soil, said second means located near the solid end of the first rod.

4. The stake driver of claim 1 includes a removable means for establishing a grade elevation, said means removably connectable to the first rod so that by sighting over said means the grade elevation of the top of the stake may be determined.

5. The stake driver of claim 1 including a third rod removably insertable over and connectable to the second rod so as to provide additional weight to more easily drive the pointed end into rocky or hard soil and means for removably connecting the third rod to the second rod.

6. The stake driver of claim 1 including a means for keeping a stake that is smaller than the bore of the second rod located within the second rod.

7. The stake driver of claim 1 including means for removably securing the second rod to the first rod so that the first and second rods act as one so as to make carrying the stake driver easier as well as to use the stake driver as a grade rod to determine the elevation of the stake.

8. The stake driver of claim 1 including a further rod insertable over one end of the first rod, a threaded member extending from the further rod to connect a surveying reflector to the threaded member, said further rod also able to serve as extra weight added to the first rod that drives the stake into the soil.

9. The stake driver of claim 8 including a shovel blade connected to the fourth rod and means for removably connecting the fourth rod to the first rod.

10. A stake driver for use in driving stakes, hubs, pegs or ginies for surveys, earthwork measurements, and approximate guides for excavation by a user of the stake driver who stands in an upright position while using the stake driver, comprising a first rod having at least one solid end and an end opposite the solid end; wherein the first rod has a pointed end for penetrating soil prior to driving a stake; a second rod having a bore extending longitudinally through the second rod and wherein the second rod has slotted open end and the first rod is slidably locatable into the second rod which is positionable over a stake inserted into the open slotted end of the second rod adjacent to the soil so that the user grasps the second rod while lifting the first rod so in turn, when said first rod is released, the stake held in place against the soil by the second rod is driven into the soil by the first rod when the first rod hits the stake; a first means for stopping the motion of the second rod so that the resulting impact drives the pointed end into the soil, said first means located near the pointed end of the first rod; and a second means for stopping the motion of the second rod so that when the pointed end is driven into the soil the impact of the second rod against said means will drive the pointed end out of the soil, the second means located near the solid end of the first rod.

11. The stake driver of claim 10 including a third rod removably insertable over the second rod so as to provide additional weight to more easily drive the pointed end of the first rod and means for removably connecting the third rod to the second rod.

12. The stake driver of claim 10 including a further rod insertable over one end of the first rod and a threaded member extending from the further rod.

13. The stake driver of claim 10 including a further rod, a shovel blade connected to the further rod, said further rod removably insertable over the upper end of the first rod and a threaded member extending from one end of the further rod so that a survey reflector can be threadably connected to the threaded member and means for securing the further rod to the first rod.

14. The stake driver of claim 10 including a means for keeping a stake that is smaller than the bore of the second rod located therein.

15. A stake driver for use in driving stakes, hubs, pegs or ginies for surveys, earthwork measurements, and approximate guides for excavation by a user of the stake driver who stands in an upright position while using the stake driver, comprising a first rod having at least one solid end and an end opposite the solid end; wherein the first rod has a removable pointed end for penetrating the soil prior to driving a stake; a second rod, wherein the second rod has slotted open end and is slidably locatable over the first rod and positionable over a stake inserted into the open slotted end of the second rod adjacent to the soil so that the user grasps the second rod while lifting the first rod so in turn, when said first rod is released, the stake held in place against the soil by the second rod is driven into the soil by the first rod when the first rod hits the stake; means for removably securing the second rod to the first rod so that the first and second rods act as one to facilitate use as a grade rod and carry the first and second rods; a first means in said first rod for stopping the motion of the second rod so that when the pointed end is to be driven into the soil the impact of the second rod against the first means for stopping will drive the rod into the soil; a second means in said first rod for stopping the motion of the second rod so that when the pointed end of the first rod has been driven into the soil the impact of the second rod against the second means for stopping will drive the pointed end out of the soil; a third rod insertable over the second rod so as to provide additional weight to more easily drive the pointed end of the first rod; means for removably connecting the third rod to the second rod; a fourth rod, said fourth rod removably insertable over the end opposite the solid end of the first rod; a threaded member extending from one end of the fourth rod so that a survey reflector can be threadably connected to the threaded member; and said fourth rod can add additional weight to the first rod when the first rod is used to drive a stake.

16. The stake driver of claim 15, wherein the fourth rod has a shovel blade connected to the fourth rod.

17. The stake driver of claim 15 including a means for establishing grade elevation so that by sighting over said means a grade elevation may be determined at the location of the stake driver.

18. A stake driver for use in driving stakes, hubs, pegs or ginies for surveys, earthwork measurements, and approximate guides for excavation by a user of the stake driver who stands in an upright position while using the stake driver, comprising a first rod having at least one solid end and an end opposite the solid end; wherein the first rod has a pointed end for penetrating the soil prior to driving the stake and a bore at the solid end of the first rod; a second rod, wherein the second rod has slotted open end and is slidably locatable over the first rod and positionable over a stake inserted into the open slotted end of the second rod adjacent to the soil so that the user grasps the second rod while lifting the first rod so in turn, when said first rod is released, the stake held in place against the soil by the second rod is driven into the soil by the first rod when the first rod hits the stake; means for removably securing the second rod to the first rod so that the first and second rods act as one; a collar connected to the first rod below the pointed end of the first rod for stopping the motion of the second rod so that the impact of the second rod against the collar will drive the pointed end of the first rod into the soil; a removable spring clip insertable in the bore in the solid end of the first rod for stopping the motion of the second rod so that when the pointed end of the first rod has been driven into the soil the impact of the second rod against the spring clip will drive the pointed end out of the soil; a third rod insertable over the second rod so as to provide additional weight to more easily drive the pointed end of the first rod; means for removably connecting the third rod to the second rod; a fourth rod, said fourth rod removably insertable over the end opposite the solid end of the first rod; a threaded member extending from one end of the fourth rod so that a survey reflector can be threadably connected to the threaded member, and said fourth rod can add additional weight to the first rod when the first rod is used to drive a stake; a shovel blade connected to the fourth rod; means for securing the fourth rod to the first rod; and a removable hand operatable clip connectable to a portion of the first rod exposed above the second rod to provide a horizontal extension so that by sighting across the clip the grade elevation of the stake may be established at the location of the stake driver.

19. The stake driver of claim 18 including a detent spring connected to the external wall of the second rod and passing through a bore in the second rod to press against the stake.

20. A stake driver for use in driving stakes, hubs, pegs, or ginies for surveys, earthwork measurements, and approximate guides for excavation by a user of the stake driver who stands in an upright position while using the stake driver, consisting of a first rod having at least one solid end and a second rod having a bore extending longitudinally through the second rod and two opposite open ends, the first rod having a diameter not exceeding the diameter of the bore of the second rod and the first rod slidably locatable into the second rod and positionable over a stake inserted into the open end of the second rod adjacent to soil so that the user grasps the second rod while lifting the first rod so in turn, when said first rod is released, the stake held in place against the soil by the second rod is driven into the soil by the impact of the first rod when the first rod hits the stake.

* * * * *